US005467811A

United States Patent [19]

Suehiro et al.

[11] Patent Number: 5,467,811

[45] Date of Patent: Nov. 21, 1995

[54] THIN CAST STRIP OF AUSTENITIC STAINLESS STEEL AND COLD-ROLLED SHEET IN THIN STRIP FORM AND PROCESSES FOR PRODUCING SAID STRIP AND SHEET

[75] Inventors: Toshiyuki Suehiro, Hikari; Shinichi Teraoka, Futtsu; Eiichiro Ishimaru, Hikari; Yoshimori Fukuda, Futtsu; Shuichi Inoue, Hikari, all of Japan

[73] Assignee: Nippon Steel Corporation, Tokyo, Japan

[21] Appl. No.: 167,803

[22] PCT Filed: Apr. 16, 1993

[86] PCT No.: PCT/JP93/00496

§ 371 Date: Dec. 16, 1993

§ 102(e) Date: Dec. 16, 1993

[87] PCT Pub. No.: WO93/20966

PCT Pub. Date: Oct. 28, 1993

[30] Foreign Application Priority Data

Apr. 17, 1992 [JP] Japan ..... 4-098147
Dec. 14, 1992 [JP] Japan ..... 4-352809

[51] Int. Cl.[6] ..... B22D 11/16; B22D 11/00

[52] U.S. Cl. ..... 164/476; 148/542; 148/546; 29/527.7

[58] Field of Search ..... 164/476; 148/327, 148/542, 541, 546, 547, 506, 501; 29/527.5, 527.7

[56] References Cited

U.S. PATENT DOCUMENTS

| | | | |
|---|---|---|---|
| 3,974,559 | 8/1976 | Kawawa et al. | 29/527.7 |
| 4,119,442 | 10/1978 | Nagumo et al. | 148/2 |
| 4,134,440 | 1/1979 | Kawawa et al. | 164/4 |
| 5,030,296 | 7/1991 | Ueda et al. | 148/2 |
| 5,188,681 | 2/1993 | Teraoka et al. | 148/603 |
| 5,284,535 | 2/1994 | Ueshima et al. | 148/610 |

FOREIGN PATENT DOCUMENTS

| | | |
|---|---|---|
| 157447 | 7/1985 | Japan . |
| 2-133528 | 5/1990 | Japan . |
| 3-72030 | 3/1991 | Japan . |
| 525548 | 2/1993 | Japan . |
| 559446 | 3/1993 | Japan . |

OTHER PUBLICATIONS

ASM, *The Making Shaping and Treating of Steel*, 9th Edition, pp. 853, 1179, & 1180.

*Primary Examiner*—P. Austin Bradley
*Assistant Examiner*—Randy Herrick
*Attorney, Agent, or Firm*—Kenyon & Kenyon

[57] ABSTRACT

An austenitic stainless steel sheet is produced by a twin-roll synchronous continuous casting process wherein the sheet has a Ni segregation ratio in the vicinity of its center section of 0.90 or more and $\delta Fe_{cal.}$ (mass %) is 6 mass % or more. Ni segregation ratio is defined by the formula: {average Ni content of the segregated portion (%) }/{average Ni content of the cast sheet (%)}; where Ni content is expressed in % by mass. $\delta$-$Fe_{cal.}$ (mass %) is defined by the formula: 3(Cr+1.5 Si+Mo+0.5 Nb)−2.8(Ni+0.5 Cu+0.5 Mn+30 C+30 N)−19.8; wherein the chemical elements are given in % by mass.

4 Claims, 7 Drawing Sheets

CD
① COARSE (+ SPECIFIC ORIENTATION) γ GRAIN
RD
SEMI-MACROSEGREGATION
Ni POSITIVE SEGREGATED PORTION
② Ni NEGATIVE SEGREGATED PORTION

①α'
γ + α'
γ + α'
②α'

①(100)γ LOCALIZED
(112)γ+(110)γ COEXISTED
②(110)γ LOCALIZED
(112)γ+(110)γ COEXISTED

① TYPE A SURFACE ROUGHENING (DUE TO γ GRAIN)
BIAXIAL TENSION (ex = ey)
ex
ey
② TYPE B SURFACE ROUGHENING (DUE TO SEGREGATION)
γ
α'

THIN CAST STRIP OF AUSTENITIC STAINLESS STEEL AND COLD-ROLLED SHEET IN THIN STRIP FORM AND PROCESSES FOR PRODUCING SAID STRIP AND SHEET

TECHNICAL FIELD

The present invention relates to a thin cast strip of a stainless steel, having a thickness close to the thickness of a product produced by the so-called "synchronous continuous casting process" that gives rise to no difference in the relative velocity between a cast strip and an inner wall of a mold, and a cold-rolled thin sheet made from the cast strip and techniques for producing the cast strip and product sheet.

BACKGROUND ART

The synchronous continuous casting process is a synchronous continuous casting process that gives rise to no difference in the relative velocity between a cast strip and an inner wall of a mold, such as a twin-roll system, a twin-belt system or a single roll process, as introduced, for example, in feature articles in "TETSU TO HAGANE (Journal of The Iron and Steel Institute of Japan)", 85-A197 to A256. The twin-roll continuous casting process, which is a synchronous continuous casting process, is a continuous casting process wherein a molten steel is poured into a continuous casting mold comprising a pair of cooling rolls having the same or different diameter and disposed parallel to each other or disposed so as to have an inclined positional relationship and side weirs for sealing both end faces of the cooling rolls to provide solidified shells on the respective circumferential surfaces of both the cooling rolls, which solidified shells are united with each other around the nearest approach point between the two cooling rolls being rotated (the so-called "kissing point") to deliver the solidified shells as an integral thin cast strip.

The thin cast strip provided by the twin-roll continuous casting process has a thickness of several mm (usually in the range of from about 1 to 10 mm) and can be cold-rolled without prior hot rolling to provide a thin sheet product. Therefore, the twin-roll continuous casting process has marked advantages in the production efficiency and cost over a production process (slab casting-hot rolling process) which comprises casting a slab having a thickness exceeding 100 mm by continuous casting using a vibratory mold or the like, hot-rolling the slab and cold-rolling the hot-rolled sheet.

The thin sheet of an austenitic stainless steel produced by cold rolling is subjected to forming, such as bending, burring, drawing and stretching, and widely used in applications, such as building materials, dinnerware and kitchen fitments. Therefore, the sheet should have an excellent appearance after forming, not to mention excellent formability. The materials provided by the conventional hot rolling process had the product characteristics required in the above-described applications. On the other hand, the materials produced by the twin-roll continuous casting process gave rise to the following new problems when used in some of the above-described applications.

Specifically, as a result of various studies, the present inventors have found that products produced by subjecting a thin cast strip provided by the twin-roll continuous casting process or other process to cold rolling without hot rolling suffer from surface roughening along the rolling direction when subjected to forming (particularly drawing or stretching). As opposed to the orange peel phenomenon known in the art, which depends upon the grain size of the cold-rolled product sheet, the surface roughening occurs in the form of small wavy surface roughening having an average size of about several mm or less in length and 0.5 mm or less in width (hereinafter referred to simply as "type A surface roughening") and large flow pattern surface roughening having an average size of several hundred mm or less in length and about 3 mm or less in width (hereinafter referred to simply as "type B surface roughening") either alone or in combination. This surface roughening is liable to occur particularly in the stretching of BA products (bright-annealed products), which remarkably spoils the appearance of the formed article.

The surface roughening phenomenon caused in the forming is different also from "roping" that is a surface roughening phenomenon caused in the cold rolling, so that it is necessary to take new measures to prevent the type A surface roughening and type B surface roughening. For example, Japanese Unexamined Patent Publication (Kokai) Nos. 2-13352 and 2-133522 specify the average $\gamma$ grain size of the cast strip for the purpose of preventing roping. Further, Japanese Unexamined Patent Publication (Kokai) No. 2-19426 describes the refinement of the average $\gamma$ grain size by recrystallization through intermediate annealing. These methods, however, cannot completely prevent the occurrence of surface roughening in the forming of a cold-rolled product. The surface roughening in thin sheet products has not been recognized in the above-described prior art, so that no measures have been suggested.

DISCLOSURE OF INVENTION

An object of the present invention is to provide a thin cast strip of an austenitic stainless steel free from the occurrence of surface roughening in the cold forming by the so-called "synchronous continuous casting process" that gives rise to no difference in the relative velocity between a cast strip and an inner wall of a mold and a cold-rolled thin sheet of the cast strip and processes for producing said thin cast strip and said thin cold-rolled product sheet.

The subject matter of the present invention is as follows.

(1) A cast strip of an austenitic stainless steel produced by a synchronous continuous casting process, wherein the Ni segregation ratio in the vicinity of the center of section defined by the following equation (1) is regulated to 0.90 or more:

$$\text{Ni segregation ratio} = \text{average Ni content of segregated portion (\%)/average Ni content of cast strip (\%)} \quad (1)$$

wherein the Ni content is expressed in % by mass.

(2) A cold-rolled sheet in a thin strip form of an austenitic stainless steel produced by cold-rolling the cast strip produced in the above item (1), wherein the Ni segregation ratio in the vicinity of the center of section defined by the following equation (1) is regulated to 0.90 or more:

$$\text{Ni segregation ratio} = \text{average Ni content of segregated portion (\%)/average Ni content of product sheet (\%)} \quad (1)$$

wherein the Ni content is expressed in % by mass.

(3) A thin cast strip of an austenitic stainless steel produced by a synchronous continuous casting process, wherein the Ni segregation ratio in the vicinity of the center of section defined by the following equation (1) is regulated to 0.90 or more and $\delta\text{-Fe}_{cal.}$ (%) defined by the following equation (2) is regulated to 6 mass % or more:

$$\text{Ni segregation ratio} = \text{average Ni content of segregated portion (\%)/average Ni content of cast strip (\%)} \quad (1)$$

$$\delta\text{-Fe}_{cal.}\ (\text{mass \%}) = 3(\text{Cr} + 1.5\text{Si} + \text{Mo} + 0.5\text{Nb}) - 2.8(\text{Ni} + 0.5\text{Cu} + 0.5\text{Mn} + 30\text{C} + 30\text{N}) - 19.8 \quad (2)$$

wherein the Ni, Cr, Si, Mo, Nb, Cu, Mn, C, and N content is expressed in % by mass.

(4) A cold-rolled sheet, in a thin strip form, of an austenitic stainless steel produced by cold-rolling a cast strip produced in the above item (3), wherein the Ni segregation ratio in the vicinity of the center of section defined by the following equation (1) is regulated to 0.90 or more and $\delta\text{-Fe}_{cal.}$ (mass %) defined by the following equation (2) is regulated to 6 mass % or more:

$$\text{Ni segregation ratio} = \text{average Ni content of segregated portion (\%)/average Ni content of product sheet (\%)} \quad (1)$$

$$\delta\text{-Fe}_{cal.}\ (\text{mass \%}) = 3(\text{Cr} + 1.5\text{Si} + \text{Mo} + 0.5\text{Nb}) - 2.8(\text{Ni} + 0.5\text{Cu} + 0.5\text{Mn} + 30\text{C} + 30\text{N}) - 19.8 \quad (2)$$

wherein the Ni, Cr, Si, Mo, Nb, Cu, Mn, C, and N content is expressed in % by mass.

Further, the present invention provides processes for producing thin cast strips and thin sheets made of a steel as defined in the above items (1) to (4).

(5) A process for producing a thin cast strip of an austenitic stainless steel, comprising producing a thin cast strip of an austenitic stainless steel by a synchronous continuous casting process, wherein said thin cast strip is produced while applying a drum pressing force in the range of from 3 to 25 kgf/mm per unit length applied perpendicular to the kissing point across the width direction of the cooling drums to regulate the Ni segregation ratio in the vicinity of the center of section defined by the following equation (1) to 0.90 or more:

$$\text{Ni segregation ratio} = \text{average Ni content of segregated portion (\%)/average Ni content of cast strip (\%)} \quad (1)$$

Wherein the Ni content is expressed in % by mass.

(6) A process for producing a thin cast strip of an austenitic stainless steel, comprising producing a thin cast strip of an austenitic stainless steel by a synchronous continuous casting process, wherein a drum pressing force in the range of from 3 to 25 kgf/mm per unit length is applied perpendicular to the kissing point across the width direction of the cooling drums to regulate the Ni segregation ratio in the vicinity of the center section defined by the following equation (1) to 0.90 or more and $\delta\text{-Fe}_{cal.}$ (mass %) defined by the following equation (2) is regulated to 6 mass % or more:

$$\text{Ni segregation ratio} = \text{average Ni content of segregated portion (\%)/average Ni content of cast strip (\%)} \quad (1)$$

$$\delta\text{-Fe}_{cal.}\ (\text{mass \%}) = 3(\text{Cr} + 1.5\text{Si} + \text{Mo} + 0.5\text{Nb}) - 2.8(\text{Ni} + 0.5\text{Cu} + 0.5\text{Mn} + 30\text{C} + 30\text{N}) - 19.8 \quad (2)$$

wherein the Ni, Cr, Si, Mo, Nb, Cu, Mn, and C content is expressed in % by mass.

(7) A process for producing a cold-rolled sheet, in a thin strip form, of an austenitic stainless steel, comprising cold-rolling a cast strip produced by a synchronous continuous casting process, wherein a drum pressing force in the range of from 3 to 25 kgf/mm per unit length is applied perpendicular to the kissing point across the width direction of the cooling drums to regulate the Ni segregation ratio in the vicinity of the center of section defined by the following equation (1) to 0.90 or more and $\delta\text{-Fe}_{cal.}$ (mass %) defined by the following equation (2) is regulated to 6 mass % or more to provide a thin cast strip which is then descaled, cold-rolled and finally annealed:

$$\text{Ni segregation ratio} = \text{average Ni content of segregated portion (\%)/average Ni content of cast strip (\%)} \quad (1)$$

$$\delta\text{-Fe}_{cal.}\ (\text{\%}) = 3(\text{Cr} + 1.5\text{Si} + \text{Mo} + 0.5\text{Nb}) - 2.8(\text{Ni} + 0.5\text{Cu} + 0.5\text{Mn} + 30\text{C} + 30\text{N}) - 19.8 \quad (2)$$

wherein the Ni, Cr, Si, Mo, Nb, Cu, Mn, C, and N content is expressed in % by mass.

(8) A process for producing a cold-rolled sheet, in a thin strip form, of an austenitic stainless steel, comprising cold-rolling a cast strip produced by a synchronous continuous casting process, wherein a thin cast strip is produced while applying a drum pressing force in the range of from 3 to 25 kgf/mm per unit length is applied perpendicular to the kissing point across the width direction of the cooling drums to regulate the Ni segregation ratio in the vicinity of the center of section defined by the following equation (1) to 0.90 or more and then descaled, cold-rolled with a reduction ratio of 10% or more, annealed to effect recrystallization, subjected to the second cold rolling and then subjected to final annealing:

$$\text{Ni segregation ratio} = \text{average Ni content of segregated portion (\%)/average Ni content of cast strip (\%)} \quad (1)$$

Wherein the Ni content is expressed in % by mass.

BEST MODE FOR CARRYING OUT THE INVENTION

The present inventors have evaluated, through various types of forming, cold-rolled steel sheets produced by a synchronous continuous casting process, such as a twin-roll continuous casting process, and, as a result, have found that the product sheet after drawing or stretching has a roughened surface along the rolling direction. Further, they have found that the surface roughening caused by forming is attributable to anisotropic texture colonies present in the product sheet and, in the thin cast strip of an austenitic stainless steel produced by the twin-roll continuous casting process or the like, the colonies are caused by coarse columnar γ grains of the cast strip and semi-macro Ni segregation in the vicinity of the center of section of the cast strip. When these cast strips having the colonies are directly cold-rolled to provide steel sheet products which are then subjected to forming, texture colonies which will be described later are formed to actualize plastic anisotropy, so that the above-described type A surface roughening and type B surface roughening occur. For this reason, it is necessary to completely annihilate the colony or to bring the colony to fine units acceptable in the applications if the colony cannot be completely annihilated.

Figure 1A:
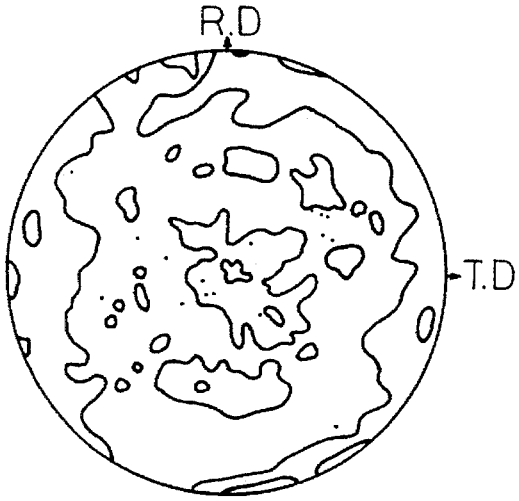
FIG. 1 illustrates texture in a (200) pole figure for each solidification mode, wherein (A) is for mode F and (B) is for mode FA.
Figure 1B:
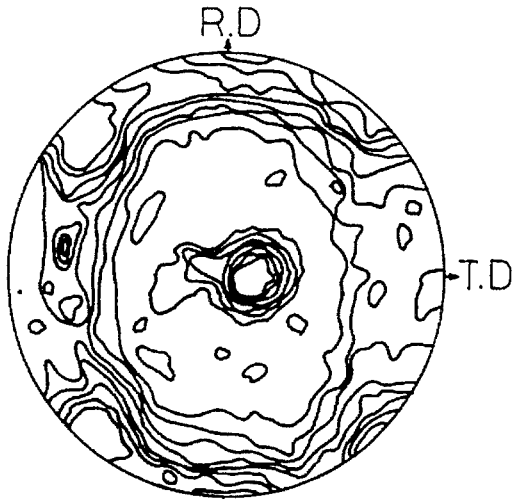
Figure 2A:
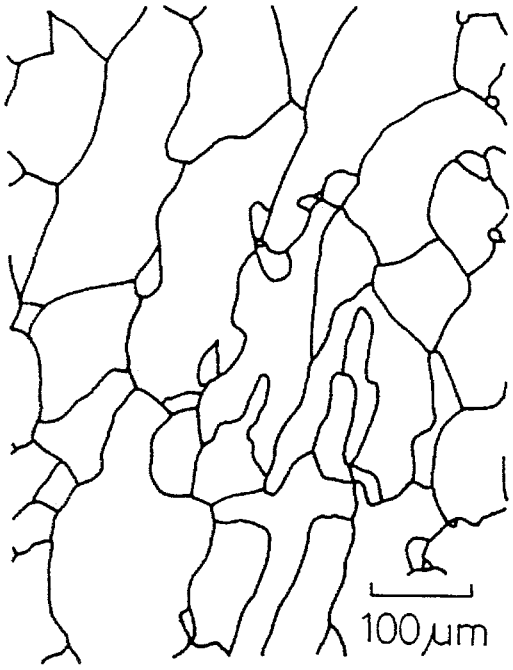
FIG. 2 is γ grain shape in a cast strip for each solidification mode, wherein (A) is for mode F and (B) is for mode FA.
Figure 2B:
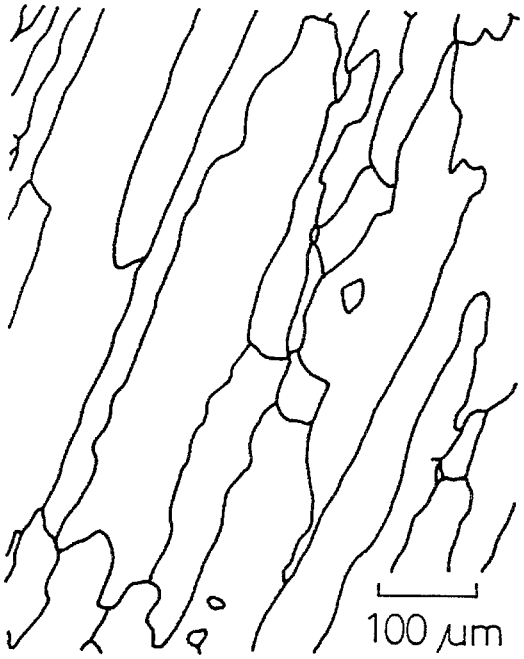
Figure 3:
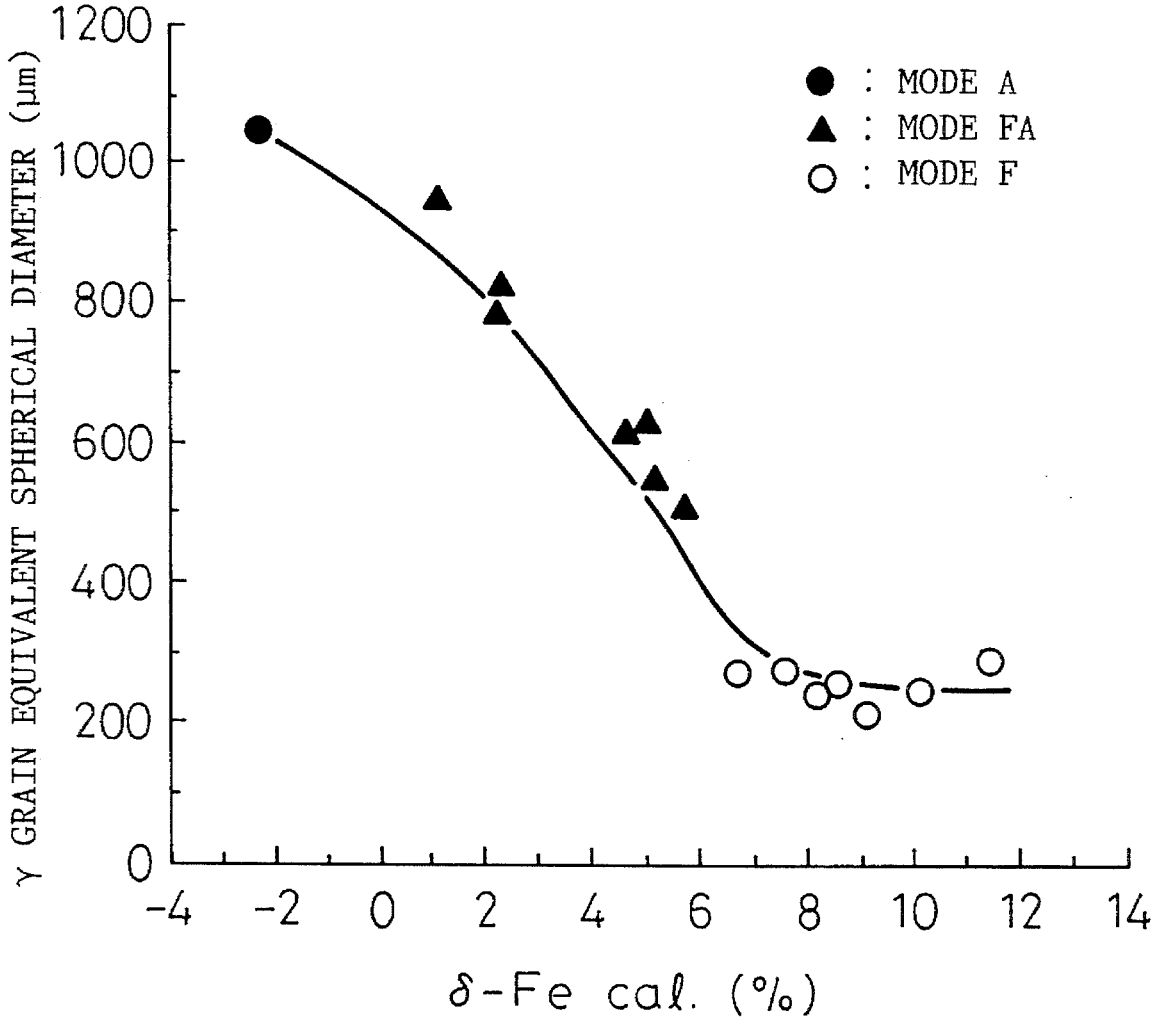
FIG. 3 is the relationship between the $\delta\text{-Fe}_{cal.}$ (mass %) value and the γ grain equivalent maximum spherical diameter of a cast strip wherein γ-max is determined by the formula $2\times(3\times\text{Smax}/2\pi)^{1/2}$ where Smax is the area of the maximum grain ($\mu m^2$)

At the outset, with respect to the type A surface roughening, the present inventors made detailed studies of the relationship between the solidified structure in a nonequilibrium state formed by rapid solidification according to the twin-roll continuous casting process and the chemical compositions with a view to finding means for refining γ grains of the cast strip. As a result, they have found that an increase in the $\delta\text{-Fe}_{cal.}$ (mass %) which is a balance between the austenitic phase (γ) and the ferritic phase (δ) shown in a Dilong phase diagram determined from the relationship between the Ni equivalent (%Ni+0.5% Cu+0.5% Mn+30% C+30% N) and the Cr equivalent (%Cr+1.5% Si+% Mo+0.5% Nb), % being mass %. As the $\delta\text{-Fe}_{cal}$ increases from zero to 6 (mass %) or more, the solidification mode changes from mode A to mode AF to mode F. In mode A, the gamma phase solidifies directly from the melt (i.e. L→γ). In mode FA, the liquid melt first solidifies by a eutectic phase transformation to form gamma plus delta, then upon further cooling the delta transforms to the gamma phase (i.e. L→γ+δ→γ). In mode F, the liquid melt solidifies to form the delta phase which then transforms on further cooling to the γ phase (i.e. L→δ→γ). This causes the solidified structure to be changed from coarse columnar γ grains to fine columnar γ grains and further to equiaxed γ grains. Specifically, when a change from the coarse columnar γ grains to equiaxed fine grains is intended, a solid phase transformation of complete δ→γ phase can be ensured by regulating the chemical compositions of the molten steel so as to satisfy a requirement that the $\delta\text{-Fe}_{cal.}$ (mass %) defined by 3 (%Cr+1.5% Si+% Mo+% Nb)−2.8(%Ni+0.5% Cu +30% C+30% N)−19.8 is 6 or more, so that the coarse columnar γ grains are broken to form an equiaxed solidified structure. Further, it was found that the texture has a random orientation wherein the intensity of (100) plane is equal to that of (110) plane and integration of a particular plane is not observed. Examples thereof are shown in FIGS. 1 and 2. FIG. 1 is a (200) pole figure for solidification mode F and solidification mode FA, wherein (A) is for mode F and (B) is for mode FA. FIG. 2 is a γ grain shape of a cast strip for each solidification mode, wherein (A) is for mode F and (B) is for mode FA. This equiaxed structure corresponds to a weld metal structure called "mode F solidification". By contrast, when the chemical compositions are not regulated in a particular range, the resultant structure corresponds to "mode A solidification" or "mode FA solidification" containing coarse columnar γ grains. As shown in FIG. 3, in the mode F solidification texture, the maximum γ grain diameter of the cast strip is reduced to about ⅕ of that of the mode A solidification structure and about ½ to ⅓ of that of the mode FA solidification, so that the type A surface roughening can be remedied to a considerable extent.

Figure 4:
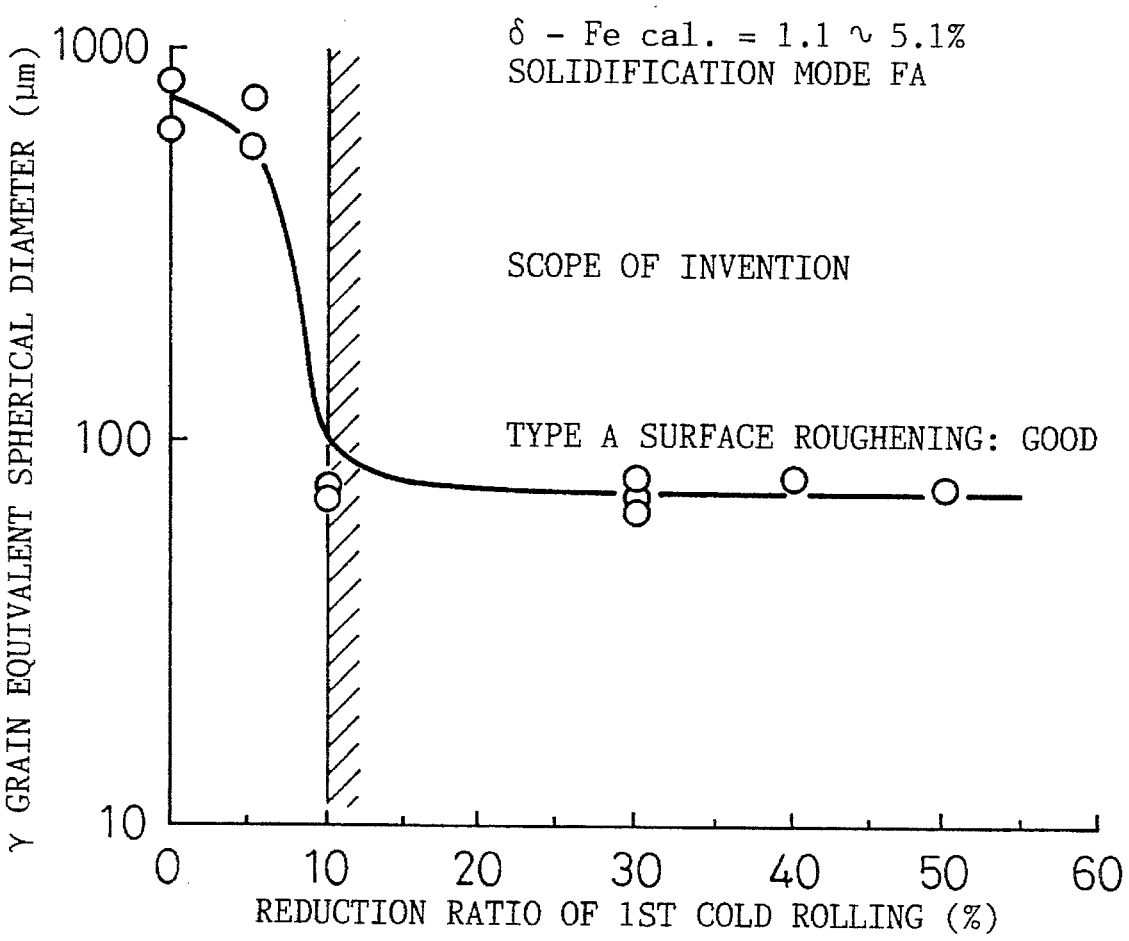
FIG. 4 is the relationship for a type A surface roughening between the reduction ratio of the first cold rolling and the γ grain equivalent maximum spherical diameter after the steel sheet subjected to the first cold rolling is annealed and recrystallized wherein γ-max is determined by the formula $2\times(3\times Smax/2\pi)^{1/2}$ where Smax is the area of the maximum grain ($\mu m^2$)

However, a further improvement is necessary for use in applications where a strict surface quality requirement should be satisfied. The best method for refining the coarse columnar γ grains is to utilize work strain-recrystallization. Means used for this purpose includes (1) recrystallization refinement by double cold rolling and (2) recrystallization refinement by hot rolling by annealing after hot rolling. In the present invention, studies have been made on the minimum reduction ratio of cold rolling required for recrystallization refinement in a cold rolling process on the premise that double rolling is effected. This has revealed that, as shown in FIG. 4, a fine recrystallized structure could be provided by subjecting the cast strip to the first cold rolling with a reduction ratio of 10% or more and then annealing the cold-rolled sheet at 1,100° C. In this connection, it is noted that the temperature necessary for the recrystallization is 800° C. or above. When the annealed sheet was subsequently subjected to the second cold rolling and then subjected to final annealing, the resultant product sheet had type A surface roughening reduced to the level of the surface roughening of the material produced by the current hot rolling process.

On the other hand, when the reduction ratio was lower than 10%, the whole cast strip thickness cannot be sufficiently recrystallized, so that the reduction in the type A surface roughening was unsatisfactory.

When the austenitic stainless steel is applied to the double cold rolling, the maximum grain size of the recrystallized grains before the second cold rolling is preferably 100 μm or less in terms of the grain equivalent spherical diameter.

In order to prevent type B surface roughening, it is necessary to remedy the semi-macro Ni segregation in the final coagulated portion. Detailed investigation of the type B surface roughening has revealed that the surface roughening occurs in the product sheet, at identical positions on both surfaces that correspond to the Ni negative segregated portion of the semi-macrosegregation. The Ni segregation in the semi-macrosegregated portion remains substantially unchanged in the step of cold rolling, so that it is necessary to take measures against this problem.

Figure 5:
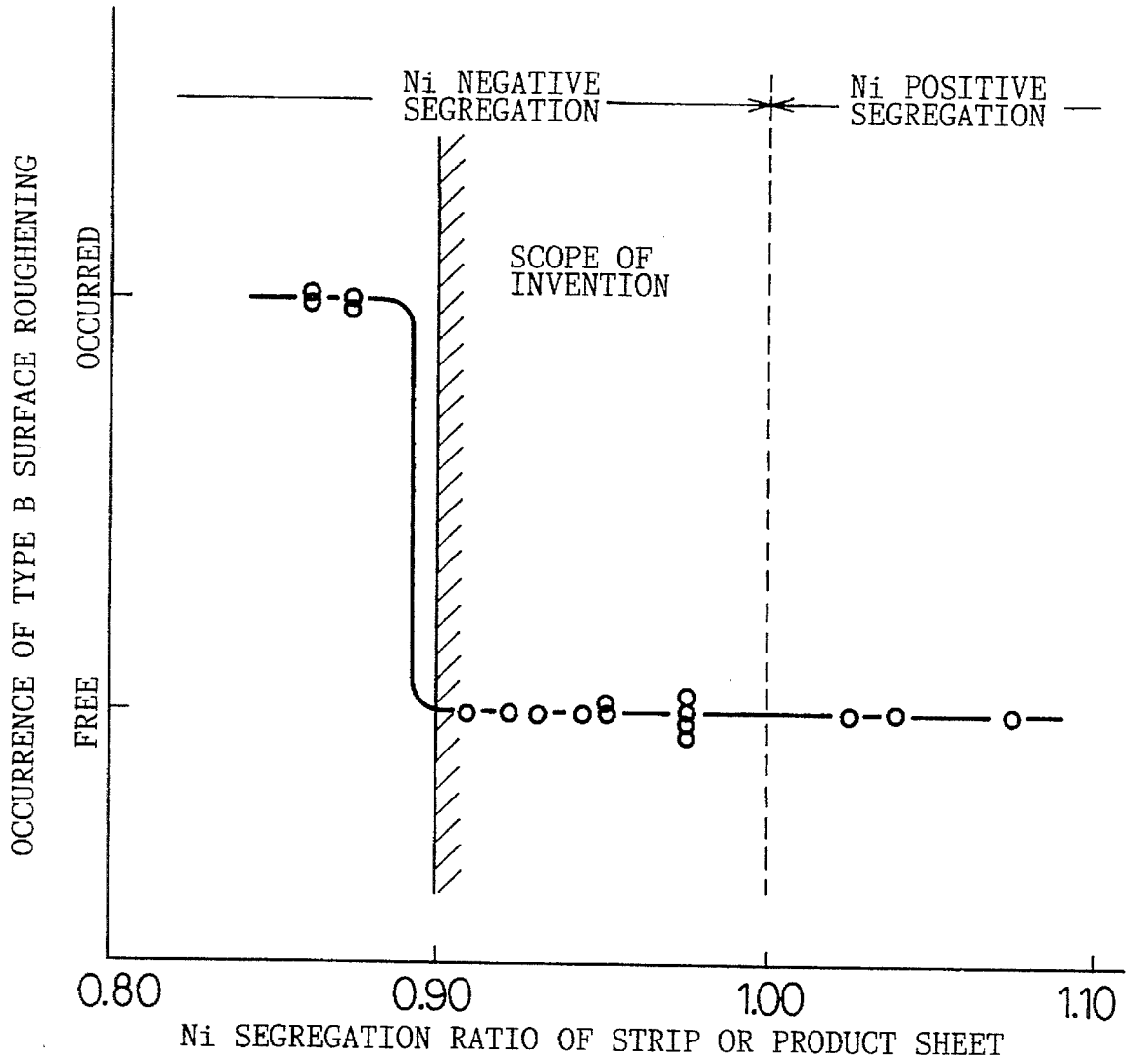
FIG. 5 is the relationship for a type B surface roughening between the Ni segregation ratio of a cast strip or a product sheet and the surface roughening.
Figure 6:
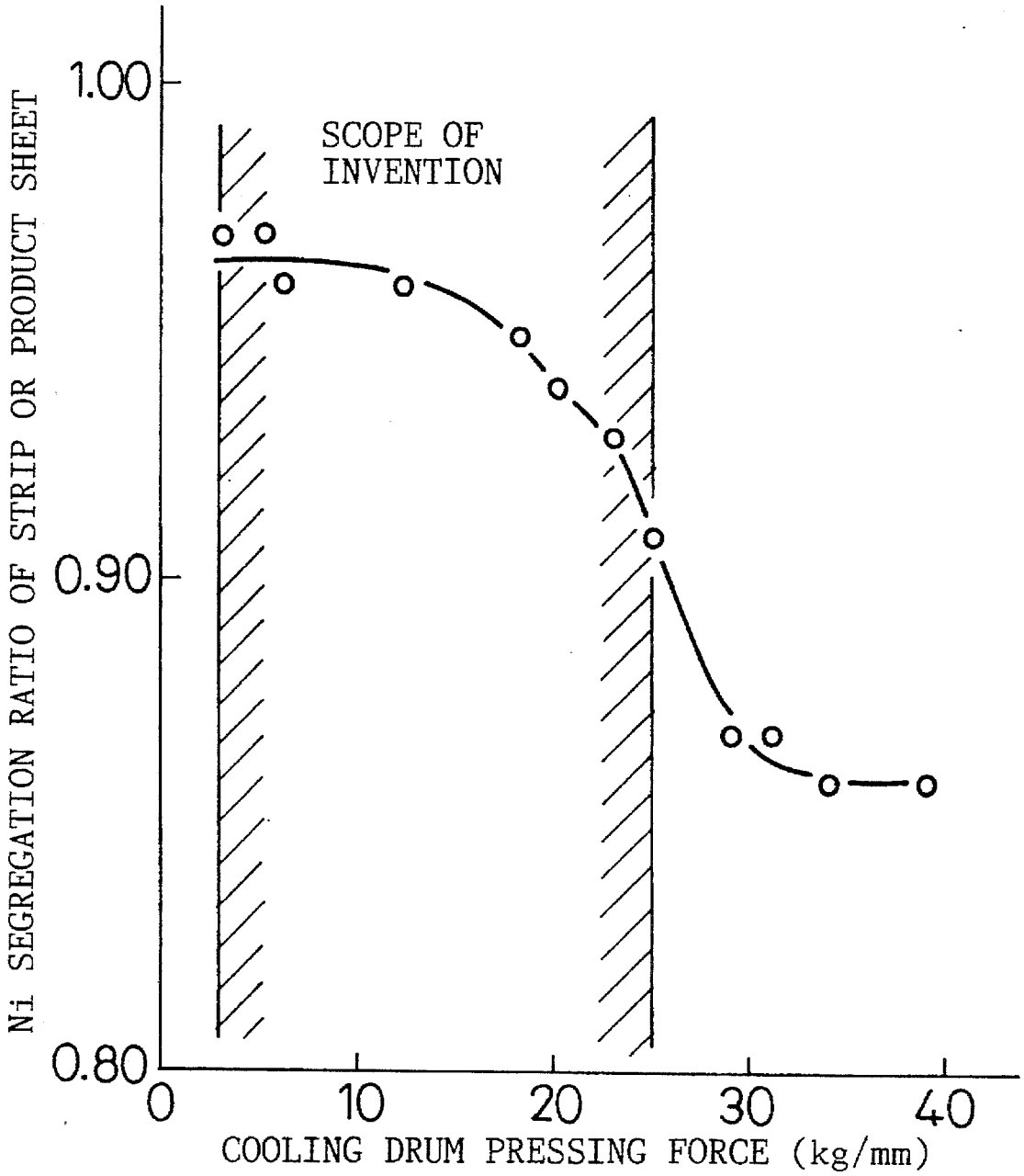
FIG. 6 is the relationship between the cooling drum pressing force and the Ni segregation ratio.

For this reason, the present inventors have effected casting of various austenitic stainless steels different from each other in the $\delta$-$Fe_{cal.}$ (mass %) value by twin-roll casting with the dram pressing force varied, cold-rolled the resultant cast strips into a thin sheet having a thickness of 0.6 m and effected stretching of a cylinder to observe whether or not the type B surface roughening occurred. Further, the Ni segregation in the vicinity of the center of section in the thickness of the width of the cast strip and product sheet was examined with an X-ray microanalyzer. The average Ni content of the segregated portion found by the analysis is a value for a portion within a region of 25 μm in the direction of the thickness and 500 μm in the direction of the width. As a result, as shown in FIGS. 5 and 6, when the casting was effected under a drum pressing force of 25 kgf/mm or less, the Ni segregation ratio was 0.90 or more for both the cast strip and product sheet and no type B surface roughening occurred. On the other hand, when the drum pressing force exceeded 25 kgf/mm, a Ni negative segregated portion having a segregation ratio of 0.90 or less was observed and type B surface roughening occurred and protruded at that position. No correlation between the degree of semi-macrosegregation and $\delta$-$Fe_{cal.}$ (mass %) was observed.

When the drum pressing force was less than 3 kgf/mm, many center porosities occurred at the center portion of the thickness of the cast strip, which gave rise to "necking" that started at the center porosities by stretching.

Figure 7A:
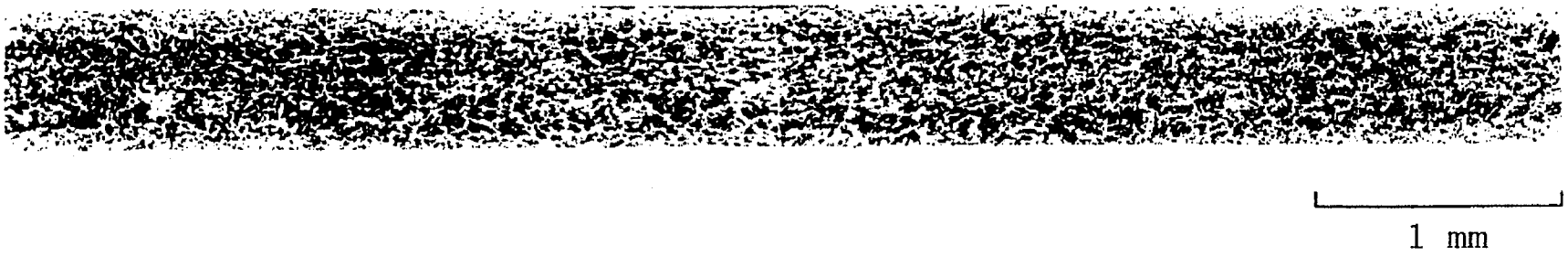
FIG. 7 is an optical microstructure showing the semi-macrosegregation remaining in a product sheet, wherein (A) shows an optical microstructure for a drum pressing force of 5 kgf/mm and (B) shows an optical microstructure for a drum pressing force of 34 kgf/mm.
Figure 7B:
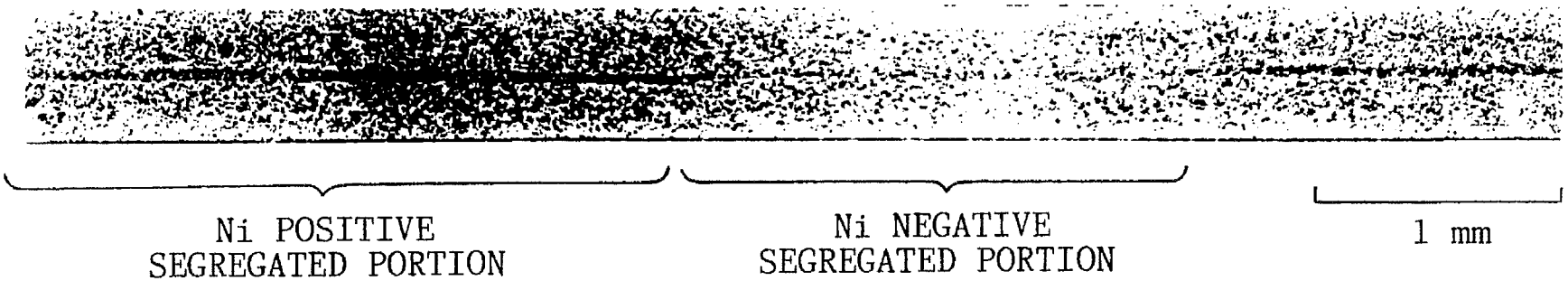

FIG. 7 shows optical microstructures of a cross-section of 0.6-mm bright-annealed materials of product sheets provided by subjecting cast strips produced under drum pressing forces of 5 kgf/mm and 34 kgf/mm to single cold rolling. It is apparent that in the product sheet of the present invention (see FIG. 7 (A)) , the semi-macrosegregation remaining at the center portion of the sheet thickness is slight and the structure is homogeneous, whereas a semi-macrosegregation having a pitch of several mm remains in the comparative example (see FIG. 7 (B)).

Figures 8A, 8B, 8C, 8D:
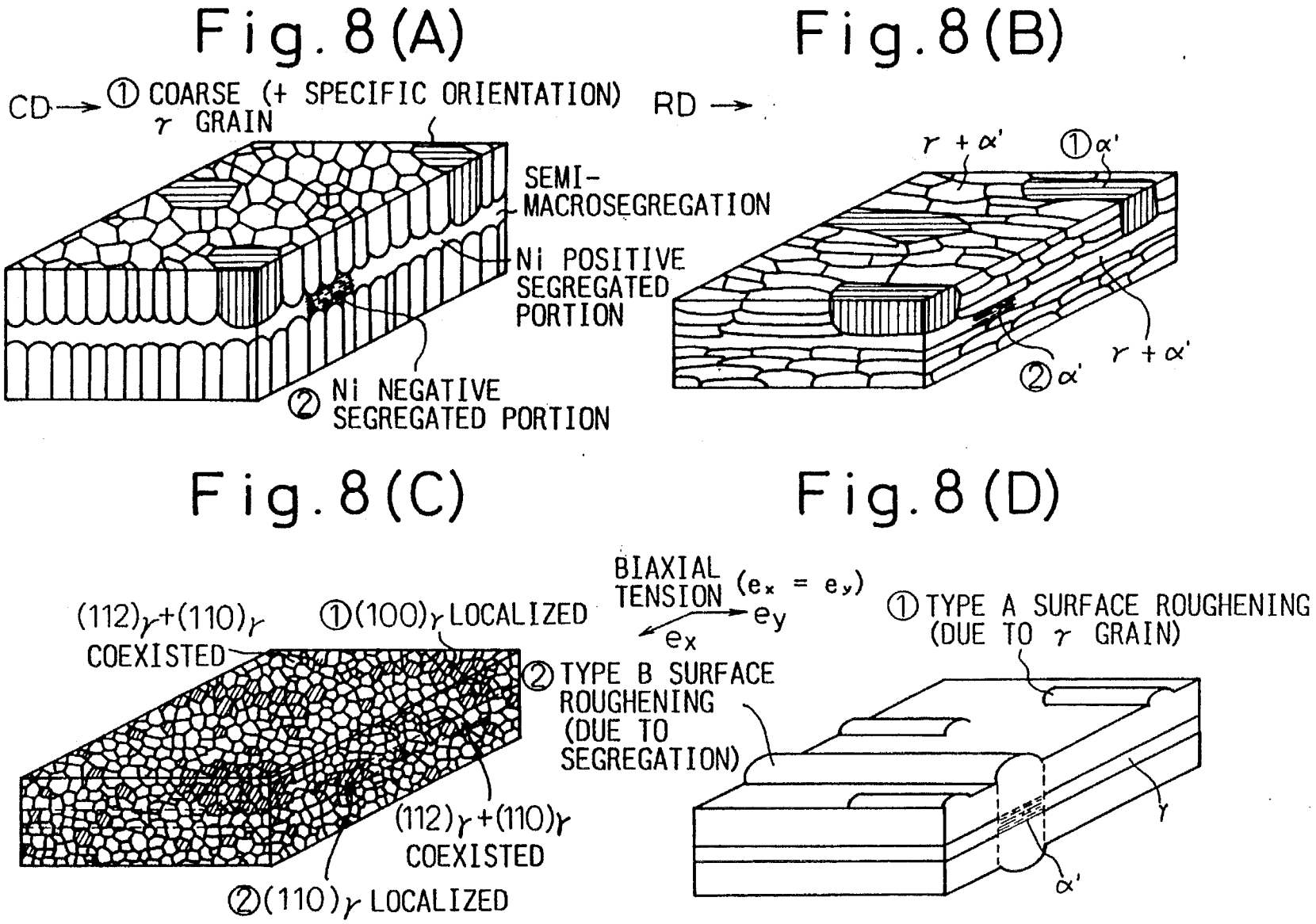
FIG. 8 is a schematic diagram showing the mechanism of occurrence of type A surface roughening and type B surface roughening, wherein (A) shows a metallic structure before cold rolling, (B) shows a metallic structure after cold rolling, (C) shows a metallic structure after annealing and (D) shows a metallic structure after forming.

The mechanism of the occurrence of surface roughening is thought to be as follows. The mechanism will now be described with reference to FIG. 8 which illustrates a structural change of a material when subjected to a series of treatments from casting to final forming. Specifically, FIG. 8 schematically illustrates the mechanism of occurrence of type A surface roughening and type B surface roughening, wherein (A) shows a metallic structure before cold rolling, (B) shows a metallic structure after cold rolling, (C) shows a metallic structure after annealing and (D) shows a metallic structure after forming.

(1) Casting structure (before cold rolling)

① A colony comprising units of coarse columnar $\gamma$ grains having a particular orientation and ② a colony comprising units of semi-macro Ni segregated portions in the case of an excessively high drum pressing force are formed in an FA mode thin cast strip of an austenitic stainless steel produced by twin-roll casting.

(2) After cold rolling

When a structure including these colonies is cold-rolled, martensitic transformation ($\gamma$ phase$\rightarrow\alpha'$ phase) occurs in the coarse columnar $\gamma$ grains of ① and work strain is likely to accumulate. On the other hand, in the Ni negative segregated portion of ②, since it comprises austenitic unstable ingredients, martensitic transformation occurs during rolling. As a result, in both cases, the cold rolling structures are different from those around them.

(3) After annealing

When the above-described cold rolling structures are annealed, in the structure ① and structure ② (Ni negative segregated portion), orientations of $\{110\}\langle 111\rangle\gamma$, $\{110\}\langle 001\rangle\gamma$, $\{110\}\langle 112\rangle\gamma$, etc. due to $\alpha'\rightarrow\gamma$ reverse transformation exist in a high proportion and colonies of textures different from textures around them and composed mainly of $\{112\}\langle 111\rangle\gamma$ or $\{113\}\langle 332\rangle\gamma$ are formed.

(4) After cold forming

When these colonies attributable to the casting structure are localized, the plastic anisotropy of the product is increased, which gives rise to surface roughening. In this case, at the stage of the cast strip, units of colonies attributable to the semi-macrosegregation of ② are larger than those of coarse columnar $\gamma$ grains, so that it is considered that there occurs a difference also in the size of the surface roughening.

The reason for the limitation of constituent features of the present invention will now be described.

In the first invention, the Ni segregation ratio was limited to 0.90 or more for the purpose of preventing the type B surface roughening.

The second invention relates to a cold-rolled sheet produced by cold-rolling the cast strip of the first invention. Since the Ni segregation ratio of the cold-rolled sheet is not different from that of the cast strip, as with the first invention, the Ni segregation ratio was limited to 0.90 or more.

In the third invention, the $\delta$-$Fe_{cal.}$ (mass %) and Ni segregation ratio were limited respectively to 6 mass % or more and 0.90 or more for the purpose of preventing the type A surface roughening and type B surface roughening. When the $\delta$-$Fe_{cal.}$ (mass %) value is 6 mass % or more, the solidification mode is changed from mode FA to mode F, so that the coarse columnar $\gamma$ grains become relatively fine equiaxed $\gamma$ grains, which contributes to a seduction in the type A surface roughening.

The fourth invention relates to a cold-rolled sheet produced by cold-rolling the cast strip of the third invention. As with the third invention, the $\delta$-$Fe_{cal.}$ (mass %) and Ni segregation ratio were limited respectively to 6 mass % or more and 0.90 or more for the purpose of preventing the type A surface roughening and type B work surface roughening.

In the fifth invention directed to a process for casting the strip having a Ni segregation ratio of 0.90 or more according to the first invention, the drum pressing force was limited to 3 to 25 kgf/mm for the purpose of preventing the type B surface roughening. In this case, when the drum pressing force is less than 3 kgf/mm, many center porosities occur, which gives rise to "necking" that starts at the center porosities by stretching. On the other hand, when the drum pressing force exceeds 25 kgf/mm, the Ni segregation ratio becomes less than 0.90, so that the type B surface roughening occurs.

In the sixth invention directed to a process for producing the cast strip of the third innovation that aims to prevent the type A surface roughening and type B surface roughening, the $\delta$-$Fe_{cal.}$ (mass %) value was limited to 6 mass % or more and the drum pressing force was limited to 3 to 25 kgf/mm for the purpose of providing a Ni segregation ratio of 0.90 or more. The reason for the limitation of the drum pressing force is the same as that in the fifth invention.

In the seventh invention directed to a process for producing the cold-rolled steel sheet of the fourth invention by single cold rolling that aims to prevent the type A surface roughening and type B surface roughening, the $\delta$-$Fe_{cal.}$ (mass %) value was limited to 6 or more and the drum pressing force was limited to 3 to 25 kgf/mm for the purpose of providing a Ni segregation ratio of 0.90 or more.

In the eighth invention directed to a process for producing the cold-rolled sheet of the second invention by double cold rolling that aims to prevent the type A surface roughening and type B surface roughening, the reduction ratio of the first cold rolling was limited to 10% or more for the purpose of providing a recrystallized fine structure. When the reduction ratio is less than 10%, no recrystallized structure can be provided over the whole cast strip thickness region, so that the reduction in the type A surface roughening is unsatisfactory. In this case, since the type A surface roughening can be prevented by the double cold rolling, the limitation of the $\delta$-$Fe_{cal.}$ (mass %) value for refining the $\gamma$ grains is not needed. With respect to the prevention of the type B surface roughening, the drum pressing force was limited to 3 to 25 kgf/mm for the purpose of providing a Ni segregation ratio of 0.90 or more.

Thus, in the present invention, mode F solidification, which does not give rise to coarse columnar $\gamma$ grains, is ensured by regulating the $\delta$-$Fe_{cal.}$ (mass %), and the type A surface roughening attributable to the $\gamma$ grains is prevented by reducing the maximum $\gamma$ grain size of the cast strip by taking advantage of an equiaxed refined structure. Further, double cold rolling with a reduction ratio for first cold rolling of 10% or more is applied when the product is used in applications where a strict surface quality requirement should be satisfied. Further, when the prevention of the type B surface roughening is intended, the semi-macrosegregation ratio is brought to 0.90 or more by regulating the drum pressing force in the range of from 3 to 25 kgf/mm independently of whether the cold rolling used is single cold rolling or double cold rolling.

The seventh and eighth inventions are on the premise that the annealing of the cast strip is omitted. However, even though the annealing is effected, the effect of preventing type A and B surface roughening remains unchanged.

An Example of the present invention will now be described.

EXAMPLE

Molten steels of SUS304 with the $\delta$-$Fe_{cal.}$ (mass %) value varied in the range of from −2% to 12% were cast by twin-roll casting into strips having a thickness in the range of from 2 to 4.5 mm while applying a cooling drum pressing force in the range of from 1 to 40 kgf/mm. The solidified structure of the cast strips was observed, and the cast strips were descaled and then cold-rolled by single cold rolling or double cold rolling into BA products having a thickness of 0.6 m. The resultant thin sheet products were subjected to stretching of 100 mm diameter cylinders (punch-stretched height: 10 mm) to evaluate the surface roughening. Further, the Ni segregation of the semi-macrosegregated portion of the cast strips and sheet products was analyzed by an X-ray microanalyzer to determine the Ni segregation ratio. In this case, the Ni segregation ratio was defined as a ratio of the average Ni content value of a portion within a region of 25 μm in the direction of the thickness and 500 μm in the direction of the width of the center section of the semi-macrosegregated portion to the found Ni content of the cast strip or the product. The results are given in Table 1.

TABLE 1

| Classification | No. | δ- Fe cal. (%) | Casting rate (m/min) | Thickness of cast strip (mm) | Drum pressing force (kg/mm) | Solidification mode of cast strip | Ni segregation ratio of cast strip | Center porosity of cast strip | Rolling method |
|---|---|---|---|---|---|---|---|---|---|
| Invention | 1 | 6.2 | 105 | 2.1 | 3 | Mode F | 0.97 | o | Single cold rolling |
| | 2 | 6.7 | 102 | 2.3 | 20 | Mode F | 0.94 | o | Single cold rolling |
| | 3 | 7.6 | 86 | 2.4 | 5 | Mode F | 0.97 | o | Single cold rolling |
| | 4 | 8.0 | 55 | 3.0 | 25 | Mode F | 0.91 | o | Single cold rolling |
| | 5 | 8.2 | 54 | 3.1 | 12 | Mode F | 0.96 | o | Single cold rolling |
| | 6 | 9.1 | 58 | 3.0 | 18 | Mode F | 0.95 | o | Single cold rolling |
| | 7 | 10.1 | 33 | 4.5 | 6 | Mode F | 0.96 | o | Single cold rolling |
| | 8 | 11.4 | 57 | 3.0 | 23 | Mode F | 0.93 | o | Single cold rolling |
| | 9 | −2.3 | 62 | 3.1 | 10 | Mode A | 0.96 | o | Double cold rolling |
| | 10 | 1.1 | 65 | 2.9 | 8 | Mode FA | 0.95 | o | Double cold rolling |
| | 11 | 2.2 | 56 | 3.1 | 24 | Mode FA | 0.93 | o | Double cold rolling |
| | 12 | 4.6 | 60 | 3.0 | 5 | Mode FA | 0.97 | o | Double cold rolling |
| | 13 | 5.1 | 64 | 3.0 | 20 | Mode FA | 0.94 | o | Double cold rolling |
| | 14 | 7.8 | 59 | 3.0 | 5 | Mode F | 0.97 | o | Double cold rolling |
| | 15 | 8.0 | 61 | 2.9 | 25 | Mode F | 0.97 | o | Double cold rolling |
| Comp. Ex. | 16 | 2.3 | 58 | 3.0 | 29 | Mode FA | 0.87 | o | Single cold rolling |
| | 17 | 3.1 | 61 | 2.9 | 31 | Mode FA | 0.87 | o | Double cold rolling |
| | 18 | 8.6 | 55 | 3.0 | 34 | Mode F | 0.86 | o | Single cold rolling |
| | 19 | 9.1 | 57 | 3.0 | 39 | Mode F | 0.86 | o | Double cold rolling |
| | 20 | −2.3 | 62 | 3.1 | 10 | Mode A | 0.96 | o | Double cold rolling |
| | 21 | 4.6 | 60 | 3.0 | 5 | Mode FA | 0.95 | o | Double cold rolling |
| | 22 | 5.0 | 54 | 3.1 | 10 | Mode FA | 0.95 | o | Single cold rolling |
| | 23 | 5.7 | 56 | 3.0 | 1 | Mode FA | 0.98 | x | Single cold rolling |

| Classification | No. | Reduction ratio of 1st rolling in double rolling (%) | γ grain equivalent max. spherical diameter (μm) | Ni segregation ratio of product sheet | Surface roughness after stretching | | Necking defect | Corresponding invention |
|---|---|---|---|---|---|---|---|---|
| | | | | | Type A | Type B | | |
| Inven- | 1 | — | 230 | 0.97 | o | o | o | |

TABLE 1-continued

| | | | | | | | | |
|---|---|---|---|---|---|---|---|---|
| tion | 2 | — | 215 | 0.94 | o | o | o | |
| | 3 | — | 275 | 0.97 | o | o | o | 3rd invention |
| | 4 | — | 240 | 0.91 | o | o | o | 4th invention |
| | 5 | — | 210 | 0.96 | o | o | o | 6th invention |
| | 6 | — | 245 | 0.95 | o | o | o | 7th invention |
| | 7 | — | 290 | 0.96 | o | o | o | |
| | 8 | — | 220 | 0.93 | o | o | o | |
| | 9 | 50 | 75* | 0.96 | ⊙ | o | o | |
| | 10 | 40 | 80* | 0.95 | ⊙ | o | o | 1st invention |
| | 11 | 30 | 90* | 0.93 | ⊙ | o | o | 2nd invention |
| | 12 | 10 | 75* | 0.97 | ⊙ | o | o | 5th invention |
| | 13 | 30 | 80* | 0.94 | ⊙ | o | o | 8th invention |
| | 14 | 10 | 70* | 0.97 | ⊙ | o | o | |
| | 15 | 30 | 65* | 0.97 | ⊙ | o | o | |
| Comp. | 16 | — | 830 | 0.87 | x | x | o | |
| Ex. | 17 | 30 | 80* | 0.87 | ⊙ | x | o | |
| | 18 | — | 255 | 0.86 | o | x | o | |
| | 19 | 30 | 70* | 0.86 | ⊙ | x | o | |
| | 20 | 5 | 750* | 0.96 | x | o | o | |
| | 21 | 5 | 560* | 0.95 | x | o | o | |
| | 22 | — | 630 | 0.95 | x | o | o | |
| | 23 | — | 510 | 0.98 | x | o | x | |

⊙: very good
o: good
x: poor
*The γ grain size of the double cold-rolled material is a value after the first cold rolling and annealing.

Samples No. 1 to 8 are examples of the cast strip, cold-rolled sheet and processes for producing the cast strip and cold rolled sheet according to the third, fourth, sixth and seventh inventions. In these examples, in order to apply the single cold rolling, the $\delta$-$Fe_{cal.}$ (mass %) value was regulated within the range specified in the present invention, i.e., 6 or more, to provide a mode F solidifying structure, thereby bringing coarse columnar γ grains to equiaxed γ grains, so that the type A surface roughening was remedied to a level acceptable for general applications. Further, since the drum pressing force was regulated within the range specified in the present invention, the Ni segregation ratio was 0.90 or more for both the cast strip and product sheet, so that the type B surface roughening was on an acceptable level.

Samples No. 9 to 15 are examples of the cast strip, cold-rolled sheet and processes for producing the cast strip and cold rolled sheet according to the first, second, fifth and eighth inventions. In these examples, although the $\delta$-$Fe_{cal.}$ (mass %) value was varied from −2.3 to 8.0%, all the samples exhibited a fine recrystallized structure having a γ grain equivalent maximum spherical diameter of 100 μm or less by virtue of double cold rolling with a reduction ratio of first cold rolling of 10% or more, so that the type A surface roughening was significantly remedied to the level of the surface roughening of the material produced by the current hot rolling process. Further, since the drum pressing force was regulated within the range specified in the present invention, the Ni segregation ratio was 0.9 or more for all the cast strips and product sheets, so that the type B surface roughening was on a satisfactory level.

On the other hand, in sample Nos. 16 to 19 as comparative examples, the drum pressing force was so high that the Ni segregation ratio was 0.90 or less, which gave rise to the type B surface roughening.

Further, in sample No. 16, since the $\delta$-$Fe_{cal.}$ (mass %) value was outside the scope of the present invention, the type A surface roughening also occurred. In sample No. 17, since double cold rolling with a reduction ratio of first cold rolling of 30% was applied, the type A surface roughening was on a satisfactory level. In sample Nos. 18 and 19, although the type A surface roughening was on a satisfactory level because the $\delta$-$Fe_{cal.}$ (mass %) value was within the range specified in the present invention, the drum pressing force was so high that the Ni segregation ratio became 0.90 or less, which gave rise to the type B surface roughening.

In sample Nos. 20 to 22 as comparative examples, since the $\delta$-$Fe_{cal.}$ (mass %) value was outside the range specified in the present invention, the type A surface roughening occurred. In this case, although double cold rolling was applied to sample Nos. 20 and 21, since the reduction ratio of first cold rolling was less than 10%, the recrystallization was incomplete, so that the type A surface roughening occurred. Since, however, the drum pressing force was within the range specified in the present invention, the Ni-segregation ratio was 0.90 or more for both the samples, so that the type B roughening was on a satisfactory level.

Further, in sample No. 23 as a comparative example, the Ni segregation ratio was 0.90 or more, so that the type B surface roughening was on a satisfactory level. Since, however, the drum pressing force was excessively low, many center porosities occurred, which led to "necking" that started at the center porosities in the forming.

In all of these comparative examples that were outside the scope of the present invention with respect to at least one of the $\delta$-$Fe_{cal.}$ (mass %), drum pressing force and reduction ratio of first rolling, the type A or type B surface roughening occurred and the appearance was unacceptable even for use in general applications.

As is apparent also from the above-described examples, in the present invention, coarse columnar γ grains are changed to equiaxed γ grains to improve the type A surface roughening, and the regulation of the Ni segregation ratio of the cast strip and product sheet contributes to an improvement also in the type B surface roughening.

Industrial Applicability

As described above, according to the present invention, it is possible to stably produce a cold-rolled sheet, in a strip form, of an austenitic stainless steel which does not give rise to surface roughening during cold forming.

We claim:

1. A process for producing a thin austenitic stainless steel cast sheet comprising:

synchronous continuously casting a thin austenitic stainless steel sheet using a pair of cooling drums having a kissing point therebetween, each cooling drum having a width direction, wherein said cast stainless steel sheet has a center section and a Ni segregated portion in said center section vicinity;

regulating Ni segregation ratio in said center section vicinity to 0.90 or more by applying a drum pressing force perpendicular to said kissing point, said pressing force having a range of from 3 to 25 kgf/mm in the width direction of the cooling drums; and said Ni segregation ratio is defined by a formula: {average Ni content of the segregated portion (%) }/{average Ni content of the cast sheet (%)}; wherein Ni content is expressed in % by mass.

2. A process for producing a thin austenitic stainless steel cast sheet comprising:

synchronous continuously casting a thin austenitic stainless steel sheet using a pair of cooling drums having a kissing point therebetween, each cooling drum having a width direction, wherein said cast stainless steel sheet has a center section and a Ni segregated portion in said center section vicinity;

regulating Ni segregation ratio in said center section vicinity to 0.90 or more and regulating $\delta$-$Fe_{cal.}$ (%) to 6% by mass or more by applying a drum pressing force perpendicular to said kissing point, said pressing force having a range of from 3 to 25 kgf/mm in the width direction of the cooling drums;

said Ni segregation ratio is defined by a formula: {average Ni content of the segregated portion (%)}/{average Ni content of the cast sheet (%)}; wherein Ni content is expressed in % by mass;

$\delta$-$Fe_{cal.}$ (%) is defined by a formula: 3(Cr+1.5 Si+Mo+0.5 Nb)−2.8(Ni+0.5 Cu+0.5 Mn+30 C+30 N)−19.8; wherein chemical elements are given in % by mass and $\delta$-$Fe_{cal.}$ (%) is % by mass.

3. A process according to claim 2 wherein said thin cast austenitic stainless steel sheet having said Ni segregation ratio of 0.90 or more and said $\delta$-$Fe_{cal.}$ (%) of 6% by mass or more is further subjected to descaling, cold rolling, and final annealing.

4. A process according to claim 1 wherein said thin cast austenitic stainless steel sheet having said Ni segregation ratio of 0.90 or more is further subjected to descaling, first cold rolling with a reduction ratio of 10% or more, annealing to cause recrystallization, second cold rolling, and then to final annealing.

* * * * *